US005593476A

United States Patent [19]

Coppom

[11] Patent Number: 5,593,476

[45] **Date of Patent: *Jan. 14, 1997**

[54] METHOD AND APPARATUS FOR USE IN ELECTRONICALLY ENHANCED AIR FILTRATION

[75] Inventor: Rex R. Coppom, Longmont, Colo.

[73] Assignee: Coppom Technologies, Boulder, Colo.

[ * ] Notice: The term of this patent shall not extend beyond the expiration date of Pat. No. 5,549,735.

[21] Appl. No.: 571,382

[22] Filed: Dec. 13, 1995

Related U.S. Application Data

[63] Continuation-in-part of Ser. No. 257,729, Jun. 9, 1994, Pat. No. 5,549,735.

[51] Int. Cl.[6] ..... B03C 3/155

[52] U.S. Cl. ..... 95/78; 96/63; 96/68; 96/88

[58] Field of Search ..... 96/59, 63, 66, 96/68, 70, 88, 69; 95/63, 78; 55/279; 422/22, 121, 906, 907

[56] References Cited

U.S. PATENT DOCUMENTS

| | | | |
|---|---|---|---|
| 2,377,391 | 6/1945 | White | 95/78 |
| 3,073,094 | 1/1963 | Landgraf et al. | 96/66 |
| 3,392,509 | 7/1968 | Pelosi, Jr. | 96/66 |
| 3,581,462 | 6/1971 | Stump | 96/66 X |
| 3,915,672 | 10/1975 | Penney | 95/81 |
| 3,999,964 | 12/1976 | Carr | 96/59 |
| 4,193,779 | 3/1980 | Hencke | 55/290 |
| 4,210,429 | 7/1980 | Golstein | 55/279 |
| 4,251,234 | 2/1981 | Chang | 96/77 X |
| 4,265,641 | 5/1981 | Natarajan | 96/99 X |
| 4,265,643 | 5/1981 | Dawson | 55/473 X |
| 4,290,788 | 9/1981 | Pittman et al. | 55/481 X |
| 4,376,642 | 3/1983 | Verity | 55/279 X |
| 4,978,372 | 12/1990 | Pick | 96/88 X |
| 5,055,118 | 10/1991 | Nagoshi et al. | 96/88 |
| 5,133,788 | 7/1992 | Backus | 96/66 X |
| 5,330,559 | 7/1994 | Cheney et al. | 95/63 |
| 5,364,458 | 11/1994 | Burnett et al. | 96/68 X |

FOREIGN PATENT DOCUMENTS

| | | | |
|---|---|---|---|
| 53-112578 | 2/1978 | Japan | 96/66 |

OTHER PUBLICATIONS

Honeywell F50 Electronic Air Cleaner; Mar. 1992.

Universal Electrostatic Adjustable Furnace/AC Filter; Rolox Ltd. Inc., Undated.

*Primary Examiner*—Richard L. Chiesa

*Attorney, Agent, or Firm*—Duft, Graziano & Forest, P.C.

[57] ABSTRACT

A high efficiency air filtration method and apparatus utilizes a fibrous filter medium that is polarized by a high potential difference which exists between two electrodes. The electrodes include an insulated electrode and an uninsulated electrode. A corona precharger is positioned upstream of the electrodes and filter. The corona precharger creates charged particles that have an opposite charge (e.g., a positive of negative charge) determined with respect to a polarization dipole proximal to the insulated electrode. These particles cancel a trapped charge that tends to accumulate on the filter surfaces proximal to the insulated electrode.

18 Claims, 8 Drawing Sheets

METHOD AND APPARATUS FOR USE IN ELECTRONICALLY ENHANCED AIR FILTRATION

RELATED APPLICATIONS

This application is a Continuation-In-Part of application Ser. No. 8/257,729, filed Jun. 9, 1994, now U.S. Pat. No. 5,549,735, which is hereby incorporated by reference herein to the same extent as though fully disclosed herein.

BACKGROUND OF THE INVENTION

1. Field of the Invention

The present invention pertains to the field of methods and apparatus involving electronic air filtration devices. More specifically, these devices apply an electric field to polarize a filtration medium, in order to increase the filtration efficiency of the medium.

2. Statement of the Problem

Four of the top ten health problems in the United States are related to respiratory conditions that can often be alleviated by the use of an air filtration device. These problems, in order of their problem ranking, include: #1 sinusitis, #5 allergies, #7 bronchitis, and #8, asthma. Nevertheless, less than 2% of the estimated 94 million households in America currently own an air purifier. Conventional air purifiers are characterized by a variety of performance deficiencies. These filters fail to satisfy volumetric demands, are noisy and expensive to operate, or fail to provide an adequate particle removal efficiency. These performance problems have created a clear market need for the introduction of a superior air purifier at a reasonable cost.

Air filtration system designers must balance the need for high filtration efficiency against the energy requirements of pushing air through an increased resistance to air flow that is associated with the use of higher efficiency filtration media. A significant problem with conventional electronic air filtration systems is that their airflow throughput and overall efficiency often decreases as the filtration medium collects pollutants, such as particles, liquids (e.g., condensed atmospheric water), and microorganisms. The level of decreased efficiency can be significant, which results in a dramatically lower overall air cleaning benefit.

More energy is required to push air through a filter having a higher filtration efficiency derived from smaller openings. This increase in energy consumption derives from the fact that the volume of air that is moved through the filter decreases proportionally with resistance (i.e., from the smaller openings) against the volume of air flowing through the filter. Fans that are capable of moving a large volume of air against a high filter resistance are significantly more expensive, much noisier, and require more energy to operate. Purely mechanical filters that do not utilize induced electrostatic forces to enhance their efficiency are particularly burdened by air resistance problems because the filtration efficiency of these filters cannot be increased without also increasing the number of fibers in the filtration medium. The resistance to air flow increases with the number of fibers in the filter. Resistance also increases with a decrease in the average pore size openings of non-fibrous filtration media.

In recent years, very few improvements have been made in either the technology of electrostatic air filtration or the design of existing air purifiers. Conventional air filtration systems utilize two basic methods for air purification. A first method utilizes mechanical filters that consist of a flat or pleated mat of fibers contained in a supporting frame. A second category of air purifiers uses electronic or electrostatic technology to enhance the performance of the filtration medium.

Electrical air filters obtain a higher filtration efficiency from a given mechanical filter because electricity is used to induce a polarization state in the fibers of the filtration medium. The applied electric field also induces a polarization state in at least some of the particles within the airstream to be filtered. The electrostatic forces in the particles and the filter medium attract one another to bind the particles to the medium. These forces of electrostatic attraction can increase the filtration efficiency of a given filtration medium by several fold.

By way of example, a mechanical filter generally consists of a flat or pleated mat of fibers. The filter is contained in a supportive frame. The filter removes particles from air passing through it by collecting the particles as the particles contact individual fibers, or the particles are too large to pass between a plurality of fibers. The percentage of particles that are trapped determines the overall filtration efficiency, e.g., 4%, 20%, 50%, or 85%. A typical furnace filter that is used in household furnace applications is one having a thickness of about one inch. This type of filter offers an extremely low resistance to air flow, and has a very low efficiency on the order of 4–9%. This filtration efficiency can be increased to about 40% by polarizing the filter between two conductive electrodes, one of which is charged to about 14–15 kV and placed in contact with the filter.

Conventional electronic air filtration systems draw in air through a front section that imparts a positive charge to particles in the incoming air. The air and charged particles are subsequently passed between a series of plates that sequentially alternate between parts having a positive charge and grounded plates. The positive particles are repelled from the positive plates, but collect on the grounded plates. These systems typically have a very low resistance to air flow because of their open configuration.

U.S. Pat. No. 3,915,672 (1975) discloses an electrostatic precipitator having parallel grounded plate electrode dust collectors. High voltage corona wires are located between the plate electrodes. The corona wires charge the dust particles, which are then drawn to the plate electrodes. The corona wires are pulsed to prevent corona back-charging that would, otherwise, occur due to the high resistivity of the dust accumulation on the plate electrodes.

U.S. Pat. No. 5,055,118 (1991) to Negoshi et al discloses an electrostatic dust collector. A first positive ionization electrode positively ionizes dust in the incoming air. The ionized dust and air pass into a chamber having a pair of uninsulated electrodes, which are maintained at a high voltage. The electrodes are separated by an insulation layer. Columb's Law causes the dust to collect on the ground electrode where the positive charge on the dust is neutralized. The dust only collects on the grounded electrode because special gaps in the laminate prevent dust build-up on other components. Cleaning of the negative electrodes is necessary to maintain airflow.

A manuscript entitled "Electric Air Filtration: Theory, Laboratory Studies, Hardware Development, and Field Evaluations" by Lawrence Livermore National Laboratory (1983) reports various experiments in the field of electrostatic air filtration technology. The report states that an electrically enhanced filter is an ideal candidate for removing sub-micron airborne particles because an electrified filter has a much higher filtration efficiency than does a conventional non-electrified fibrous filter. The electrically enhanced filter also has a significantly lower pressure drop at the same level of particle loading, and a greatly extended useful life.

The above-identified Lawrence Livermore Laboratory report disclosed a preferred filtration system having an uninsulated electrode that was placed in front of a fibrous filter. A grounded, uninsulated electrode was placed downstream of the fibrous filter. The upstream electrode was charged to create an electric field across the fibrous filter. The applied field induced a polarization state along the respective lengths of individual fibers of the filtration medium. Thus, the fibers collected either positive or negative particles all along their lengths on both sides of the fibers because a positively or negatively charged portion of a fiber served to attract an oppositely charged portion of a particle. The filtration efficiency and longevity of the electrically enhanced filtration medium were excellent. The filtration efficiency was shown to be dependent upon the strength of the electric field between the electrodes. The strength of the electric field increases with high electrode voltages for a given distance between the electrode.

The upper limits of a field strength that may exist between two uninsulated electrodes which are retained a fixed distance apart constitutes a limiting factor of the Lawrence Livermore filtration system design. Voltage tends to arc between the electrodes when the voltage or potential between the electrodes exceeds a threshold level. The arcing can burn holes completely through the filtration medium. The arcing also constitutes a temporary short circuit between the electrodes and, consequently, substantially eliminates the benefits of the field that formerly existed between the two electrodes. The exact value of the arcing threshold level varies with the degree of contamination on the filter medium. This contamination includes, among other things, dust particles and water precipitate from the air. Thus, the system might work with an electrically enhanced efficiency when the relative humidity was very low, but would fail when the relative humidity value was very high. The Lawrence Livermore test data reports arcing at a 12 kV potential between electrodes spaced about one-half inch apart across a fibrous filter.

The Livermore study attempted to overcome the arcing problem through the use of insulated electrodes. This attempt failed because trapped charges eventually neutralized the effect of the applied field. Charged particles tended to collect or migrate onto the filter surfaces proximal to an electrode having an opposite charge with respect to that of the particles. Thus, a corresponding trapped charge grew on the filter surfaces proximal to the insulated electrodes. The trapped charge had the effect of reducing the applied field that was able to reach the filter medium. This deleterious effect is known in the electronics industry as 'screening' of the applied field because the field coming from its electrode origin interacts with the trapped charge in such a way as to reduce the magnitude of the applied field that is able to reach positions located downstream of the trapped charge.

The performance of the Livermore filtration system using insulated electrodes deteriorated drastically as opposite charges built up and substantially neutralized the applied electric field (see the Livermore report on page 103). Persistent arcing between the electrodes prevented the model from becoming commercially feasible. Thus, the insulated electrodes prevented the arcing problem, but caused a decline in the filtration efficiency as collected charges neutralized the applied field. The Lawrence Livermore report, accordingly, indicated that uninsulated electrodes having high resistivity might provide a satisfactory solution to the problem.

U.S. Pat. No. 5,330,559 (1994) teaches the use of a non-deliquescent foam (one that does not attract water) that is sandwiched between an uninsulated high resistivity electrode and an uninsulated ground support frame. Incoming air is exposed to an ionizer that serves to charge particles in the air. The high resistivity electrode fails to prevent shorting or arcing between the high resistivity electrode and the ground plate. This design fails to prevent shorting or arcing between the electrode and the ground (or between the two electrodes). Thus, the filtration system utilized a non-deliquescent foam in an effort to overcome the arcing problem and, specifically, arcing problems that derive from high levels of relative humidity.

There remains a true need for method and apparatus that overcome the problem of arcing between the electrodes while permitting higher filtration efficiencies derived from insulated electrodes. The present inability to apply higher field values constitutes a limiting factor in the development of further efficiency enhancements in the field of electronically enhanced air filtration technology.

SOLUTION

The present invention overcomes the problems that are outlined above by providing method and apparatus that obtain higher electronically enhanced filtration efficiencies through the use of correspondingly higher applied fields. The enhanced level of efficiency can range up to 99.99% including the removal of sub-micron sized particles. Additionally, the filtration apparatus has a greatly reduced sensitivity to performance degradation that derives from arcing and the effects of trapped charge screening upon the applied field.

In broad terminology, the electronic air filtration device includes a corona precharger that is positioned upstream of an electrode pair. A filtration medium is positioned between a first member of the electrode pair and a second member. One of the first and second members of the electrode pair is covered with insulation to prevent the flow of current between the two electrode members. At least one of the electrode members is charged to create a voltage or potential difference between the two electrodes. The potential difference serves to polarize the filtration medium. The use of an insulated electrode is associated with essentially no diminution in the field emanating from the insulated electrode.

The enhanced level of filtration efficiency derives from the use of the corona precharger in combination with the polarized filtration medium. The use of an insulated electrode facilitates exposure of the filtration medium between the electrodes to a greater field strength than is possible in devices having non-insulated electrodes. The greater field strength correspondingly enhances the particle removal efficiency of the filtration medium. The electrodes are selectively charged to induce a corresponding polarization state in the filtration medium, which in its polarized state has a 'special relationship' with respect to the charge that is imparted to airborne particles by the corona precharger. The nature of the is 'special relationship' is discussed below.

Details pertaining to the above-mentioned 'special relationship' are essential to an understanding of the present invention. Specifically, the induced polarization state that exists on fibers of the filtration medium includes the fibers having a positive dipole and a negative dipole that is established along the length of the fibers. The electrodes themselves also provide a positive dipole and a negative dipole for the field that exists between the electrodes. The field-induced polarization state of the filtration medium is such that the positive dipole of a filter fiber exists proximal to the negative dipole of the electrode pair. Similarly, the negative dipole of a filter fiber exists proximal to the positive dipole of the electrode pair. The above-mentioned 'special relationship' exists when the corona precharger imparts airborne particles with a charge that is opposite that of the induced filter fiber dipole proximal to the insulated electrode.

In the configuration that is described above, the incoming air will include naturally charged particles that have respective positive and negative net charges, as well as some uncharged or neutral particles. The corona precharging is only capable of charging some of these particles, and cannot charge all of these particles. Thus, particles having respective negative, positive, and neutral charges all reach the filtration medium. The forces of electrostatic attraction provide the negatively charged particles with an affinity for the positive filter fiber dipoles. Similarly, the positively charged particles have an affinity for the negative filter fiber dipoles. The charges of these respective particles accumulate on the filter, and migrate through the filtration medium towards an electrode having an opposite charge with respect to the accumulated charge on the filter. The charge that migrates towards the uninsulated electrode is drained from the filter when the charge contacts the uninsulated electrode. The charge that migrates towards the insulated electrode, however, cannot be drained because the insulation surrounding the insulated electrode prevents the charge from contacting the electrode.

The charge that migrates towards the insulated electrode must be eliminated because a large charge accumulation proximal to the insulated electrode has the effect of screening the applied electric field. This removal is accomplished by incoming particles from the corona precharger. By virtue of the above-mentioned 'special relationship,' the corona-charged particles bear a charge that is opposite to that of the trapped charge proximal to the insulated electrode. The net charge on the corona-charged particles serves to balance or neutralize the trapped charge, either by taking on electrons from a negative trapped charge or by adding electrons to a positive trapped charge. Thus, the corona-charged particles prevent the buildup of a trapped charge having a significant screening effect upon the applied electric field between the electrodes.

The use of an insulated electrode as one of the two electrodes permits a very high electric potential difference to be applied between the electrodes. At the same time, the insulation prevents arcing between the two electrodes at the higher potential difference. A corresponding increase in filtration efficiency is associated with the use of higher field strength because filtration efficiency increases with the field strength.

In an especially preferred embodiment, the insulated electrode is positioned upstream of the non-insulated electrode. The corona precharging is, accordingly, effective to prevent fouling of the insulated electrode because the incoming corona-charged particles have a charge that is opposite that of the insulated electrode. Thus, the insulated electrode repels the corona-charged particles, and fouling of the insulated electrode is reduced.

Another advantage of the present apparatus is that the airflow can move the filter medium away from contact with the insulated electrode. In prior art devices that utilize uninsulated electrodes without corona prechargers, movement of the filter medium to a position that no longer contacts one of the electrodes causes a corresponding reduction in filtration efficiency. This reduction occurs because a trapped charge accumulates and cannot drain into the non-insulated prior art electrode.

Other salient features, objects, and advantages will become apparent to those skilled in the art upon a reading of the discussion below, in addition to a review of the accompanying drawings.

DESCRIPTION OF THE PREFERRED EMBODIMENTS

Figure 1:
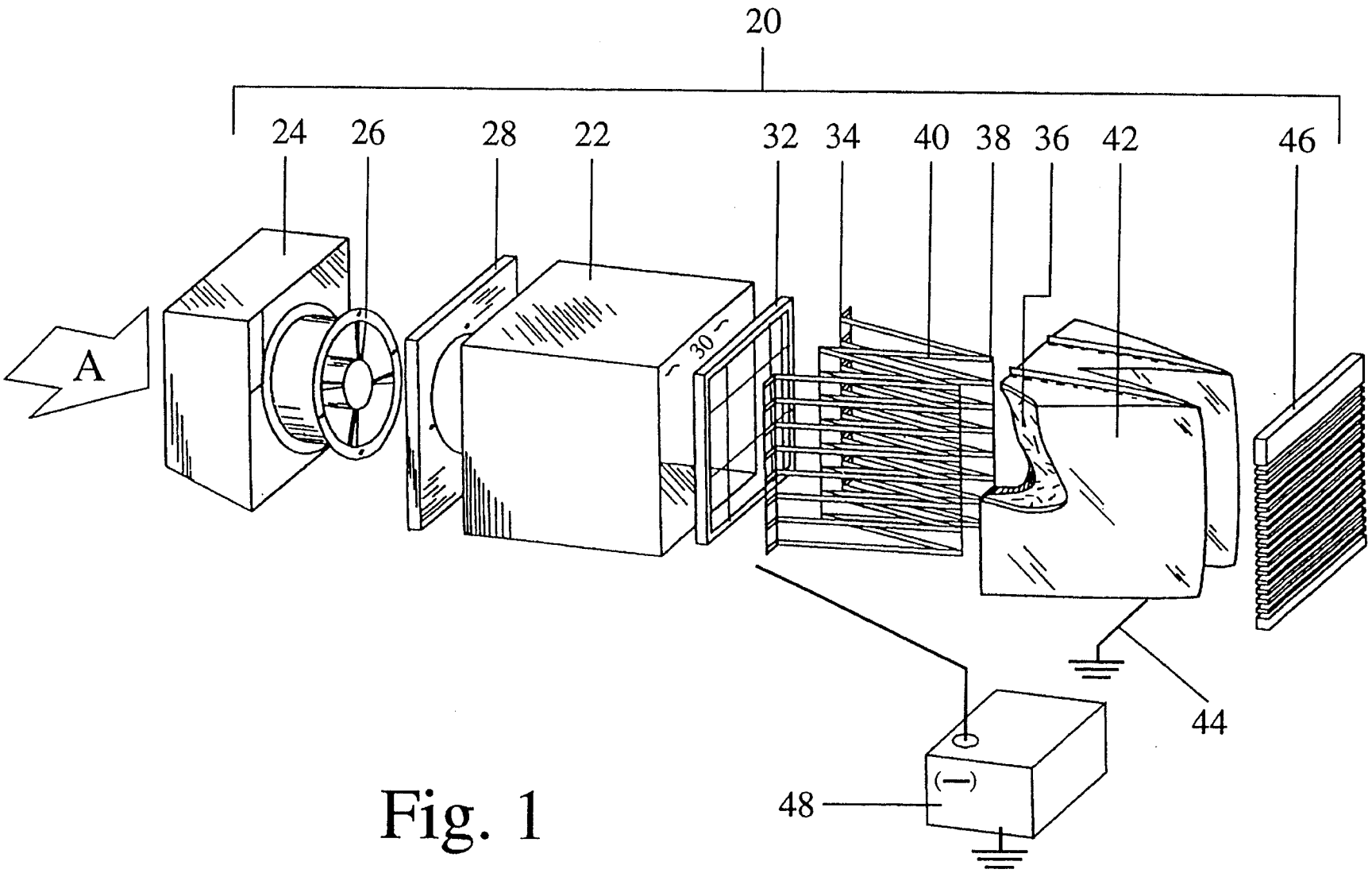
FIG. 1 depicts a top left side elevational perspective exploded view of a first embodiment of an electronically enhanced filtration system according to the present invention.

FIG. 1 depicts a room air purifier 20 including a main housing 22 which houses a rear housing 24, a conventional electrically powered blower 26, and a blower mounting plate 28 that is used to couple blower 26 with main housing 22. The interior portion 30 of main housing 22 receives precharging grid 32, and preferably holds the same in spaced relationship apart from insulated electrode grid 34.

Insulated electrode grid 34 is preferably made of a conductive electrode core, e.g., copper or another conductive metal, that is completely covered or coated with insulation. Exemplary forms of insulation include any material having a dielectric constant greater than that of the electrode, and especially materials or combinations of materials such as silicone elastomers, porcelain, mica and glass fiber having high dielectric constants. Insulated electrode grid 34 is preferably as a W to increase the surface area along its front face.

Various ways are known in the art of placing insulation on insulated electrodes, such as insulated electrode grid 34. These methods include dipping or spraying a wire or a stamped metal strand, extruding or injection molding an insulator simultaneously with a wire, and piecing together injection molded insulator halves around a wire.

The interior portion 30 of main housing 22 also receives a fibrous filter element 36. The forwardly-extending points 38 and 40 on the W of insulated electrode grid 34 are, in turn, received within the rearward interior spaces of the correspondingly shaped fibrous filter element 36. The forward surface of fibrous filter element 36 is preferably covered by an uninsulated activated carbon electrode 42, which contacts the forward surfaces of fibrous filter element 36. Carbon electrode 42 is also received within main housing 22. Carbon electrode 42 is connected to an electrical ground 44. Outlet grill 46 covers the forward portion of main housing 22 to retain the assembly including precharging grid 32, insulated electrode 34, fibrous filter 36, and carbon electrode 42, within main housing 22. A power supply 48 preferably charges insulated electrode grid 34 with a negative voltage.

In operation, blower 26 moves particle-laden incoming air A through main housing 22 and through outlet grid 46. The air A passes through the precharging grid 32, which acts as a corona precharger to ionize particles in the air to a negative state. Precharging grid 32 is preferably charged to 10 K–50 K volts DC. The air next passes through the insulated high voltage electrode grid 34, which is also preferably charged negatively with the same 10 K–50 K volts DC. The air next passes through the fibrous filter 36, which captures particles or particulates from the air A. The air next passes through the grounded carbon electrode 42. The cleansed air then exits the outlet grill 46. It should be noted that an equivalent embodiment would precharge the air with a positive charge at precharging grid 32 and reverse the polarity of the charging electrodes 34, 42. The charged particles from precharging grid 32 serve to neutralize trapped charges that accumulate on filter surfaces proximal to insulated electrode grid 34. More detail is provided with respect to this effect in the discussion of FIG. 4 below.

The provision of insulated electrode grid 34 advantageously makes the purifier 20 substantially insensitive to the presence of water vapor in the air. In prior systems that required the use of uninsulated electrodes past, field strengths often had to be drastically reduced to accommodate humid conditions. For example, a field of about 20–30 kV per inch would often produce arcing between the electrodes at a condition of about 80% relative humidity. Thus, systems that had to be used in conditions exceeding 80% relative humidity were required to reduce their operational voltage. The present invention overcomes the problem of charge accumulation that is associated with the use of insulated electrodes, and permits the consistent use of greater field strengths, e.g., 20, 30, 40, 50, 60, 70, or more kV per inch. Additionally, the filter medium 36 can be either a conductive or nonconductive medium, and it is not necessary that both the insulated electrode grid 34 and the uninsulated electrode grid 42 contact the filter medium 36. It is only necessary for uninsulated electrode grid to contact filter medium 36 for purposes of draining accumulated particle charge from filter medium 36.

Figure 2:
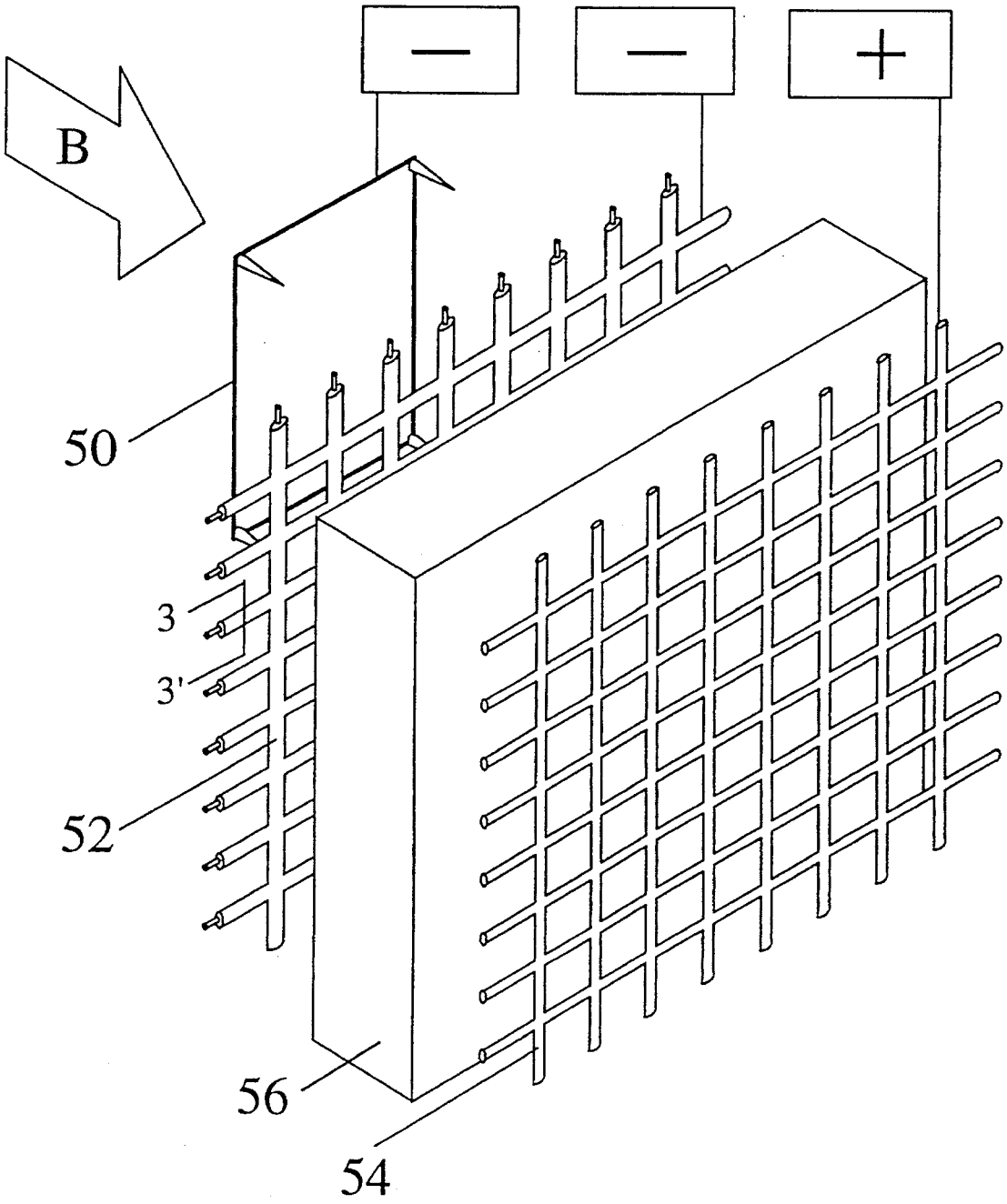
FIG. 2 depicts a top left side elevational perspective view of operational elements in a second embodiment of an electrostatic air filtration system according to the present invention.

FIG. 2 depicts a second embodiment having a negatively charged electrode and a positively charged electrode. Precharger 50 is negatively charged (e.g., at 10 kV to 50 kV) and imparts a corresponding negative charge to particles within incoming air B. An upstream insulated electrode grid 52 has a negative charge. A downstream uninsulated conductive electrode grid 54 has a positive charge. The potential difference between the pair of electrode grids 52 and 54 preferably exceeds 14 kV, and even more preferably exceeds 50 kV. A fibrous filter 56 is positioned between the insulated electrode grid 52 and the uninsulated electrode grid 54. The voltage or potential difference between electrode grids 52 and 54 is associated with a corresponding electric field, which polarizes fibrous filter 56 to enhance the filtration efficiency thereof. Substantially the same effect could be obtained by connecting uninsulated electrode grid 54 to ground.

Figure 3:
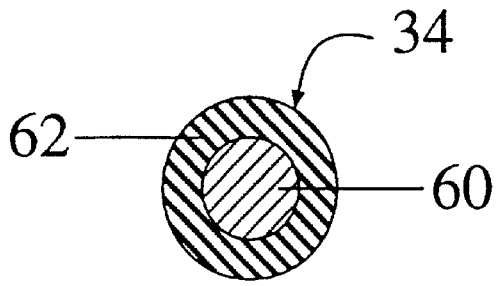
FIG. 3 depicts a sectional view taken along line 3—3' of FIG. 2.

FIG. 3 depicts a sectional view taken along line 3—3' of FIG. 2. The insulated electrode grid 34 includes a inner conductor 60 that is circumscribed by a radially outboard layer of insulation 62 that is identical to the insulation surrounding insulated electrode grid 34 of FIG. 1.

Figure 4:
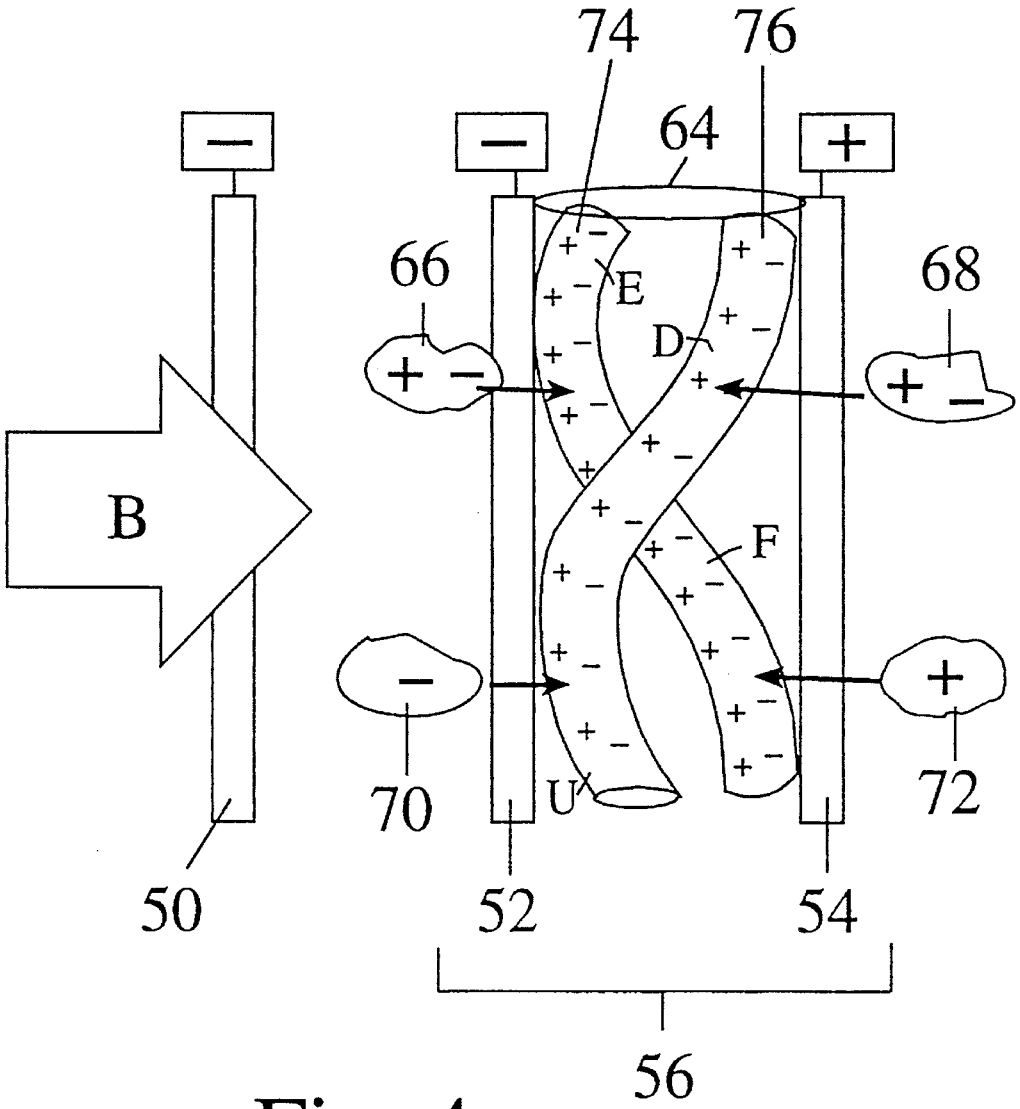
FIG. 4 depicts a front plan view of the operational concepts pertaining to the FIG. 2 filter.

FIG. 4 schematically depicts the theory of operation that underlies operation of the FIG. 2 embodiment. A field 64 derives from the potential difference between the pair of electrode grids 52 and 54. This field has a negative dipole corresponding to the negatively charged insulated electrode grid 52 and a positive dipole corresponding to the positively charged uninsulated electrode grid 54.

The incoming air B contains a plurality of particles, e.g., particles 66, 68, 70, and 72. Some of these particles have no net charge at all, and are neutral, e.g., as particles 66 and 68. These particles have passed through corona precharging grid 50 without receiving a net negative charge, or include particles that formerly bore a net positive charge but have been neutralized as a consequence of their path of travel through corona precharging grid 50. Field 64 serves to polarize particles 66 and 68, i.e., each of these particles has a positive dipole and a negative dipole that derive from exposure to field 64. The positive dipole of each particle is positioned upstream and proximal to insulated electrode grid 52 because the positive dipole of each particle is attracted to the negative dipole of the field (i.e., the negative charge on electrode grid 52. Similarly, the negative dipole of each particle is attracted to the positive dipole of the field at electrode grid 54.

The particles in incoming air B also include charged particles 70 and 72. A majority of these particles are dust particles, which have a natural tendency to hold a net positive charge, e.g., as particle 72. Other negatively charged particles like particle 34 receive a net negative charge, as a consequence of their path of travel through corona precharging grid 50. A minority of particles, e.g., particle 72, carry a net positive charge that has not been neutralized or changed to a negative charge as a consequence of its path of travel through corona precharger 50.

Field 64 also serves to polarize particles 70 and 72, however, the net charge of these particles provides a relatively stronger dipole corresponding to the net charge. Thus, the negatively charged insulated electrode grid 52 repels the stronger negative dipole of the negatively charged particles, which tend not to collect on insulated electrode grid 52.

Fibers 74 and 76 are preferably made of polyester, polypropylene, or any other fibrous filtration material, and represent all of the fibers within fibrous filter 56. Fibers 74 and 76 have been polarized to provide respective positive and negative dipoles along the lengths of each fiber. According to Coulomb's Law, the effect of field 64 is to induce a positive dipole in each fiber on a fiber surface proximal to negatively charged insulated electrode grid 52. Similarly, a negative fiber dipole exists proximate positively charged uninsulated electrode grid 54. This charge separation within fibers 74 and 76 occurs because positive charges within the fibers are attracted to the negatively charged insulated electrode grid 52, while grid 52 also repels negative charges within the fibers. Similarly, negative charges within the fibers are attracted to the positively charged uninsulated electrode grid 54, while grid 54 also repels positive charges within the fibers.

Particles 66–72 are sub-micron-sized particles that could easily pass through openings between the fibers 74 and 76 were it not for the respective polarization states that are induced by field 64. The forces of electrostatic attraction cause the negative dipole of particle 66 to be attracted to the positive fiber dipole at position E on fiber 74. Particle 66 contacts fiber 74 at position E where particle 66 binds to fiber 74. Similarly, the positive dipole of particle 68 is attracted to the negative dipole of fiber 76 at position D. The net negative charge on particle 70 causes it to have an affinity for the positive dipole on fiber 76 at position U where particle 70 is collected. The net positive charge on particle 72 causes it to have an affinity for the negative dipole on fiber 74 at position F where particle 72 is collected.

Once particles 70 and 72 have contacted fibers 74 and 76, the respective positive and negative charges on particles 70 and 72 are imparted to their corresponding fibers. Accordingly, fiber 76 has a net negative charge, and fiber 74 has a net positive charge. The net charge migrates along the fiber and/or between fibers until the charge arives at the electrode grid member of opposite polarity. For example, the positive charge of particle 72 migrates to the positive dipole of fiber 74. Similarly, the negative charge of particle 70 migrates to the negative dipole of fiber 76.

The net charges continue migration across a succession of fibers, e.g., a positive charge migration from fiber 74 to fiber 76, until the net charge resides on a surface of fibrous filter that is immediately adjacent one of the electrode grids 52 and 54 that serves to attract the charge. The positively charged uninsulated electrode grid 54 contacts fibrous filter 56 and, consequently, drains the migrated negative charge from fibrous filter 56. A positive charge similarly migrates towards the negatively charged insulated electrode grid 52, but the insulation 62 (see FIG. 3) on insulated electrode grid 52 prevents grid 52 from removing or neutralizing this migrated positive charge. Nevertheless, the migrated positive charge is removed or neutralized by contact with negatively charged particles from corona precharging grid 50. For example, if a net positive charge has migrated to the positive dipole of fiber 74, a portion of this charge would be canceled by the addition of electrons from negatively charged particle 34.

In summary of FIGS. 1, 2, and 3, which are the most preferred embodiments, the dust particles are ionized to a negative state. Then they are repelled away from a like-charged upstream insulated electrode 34 or 52. Relatively rare positively charged dust particles or ions are attracted to the negatively charged insulated electrode 34 or 52, but practically all of the dust is collected along the electrified fibers, such as fibers 74 and 76. Almost no dust passes through fibrous filter 36 or 56 to clog the last electrode. The fibrous filter 36 or 56 lasts much longer than uncharged fibrous filters because the dust collects tightly and evenly all along the fibers rather than in a layer in the front of the fibrous filter. Furthermore, the formation of dust dendrites (which can create a short-circuit pathway between prior art uninsulated electrodes) is prevented.

The above-described 'special relationship' is apparent in FIG. 4. Field 64 induces a polarization state in fibers 74 and 76 wherein the fibers each have a positive dipole proximal to insulated electrode grid 52. Insulated electrode grid 54 itself constitutes a negative dipole for the field 64. The corona precharging grid 50 produces charged particles (e.g., particle 70) having a charge that is opposite to the charge of the fiber dipoles (e.g., at positions E and U) which are located proximal to insulated electrode grid 52. The negative corona particle charges are also the same as the negative dipole for field 64, i.e., the negative charge on insulated electrode 52.

It will be understood that the polarization sates of the particles and fibers depicted in FIG. 3, as well as the field polarity, will remain the same regardless of whether uninsulated electrode 54 is connected to ground, or whether electrode grid 52 and electrode grid 54 both have negative charges with electrode grid 52 having a greater negative charge than electrode grid 54. Nevertheless, it is much less preferred to charge both electrode grids 52 and 54 with the same charge because the migrated charges that must be drained by uninsulated electrode grid 54 will have to build potential until they are able to overcome a charge barrier equal the charge on uninsulated electrode grid 54. Thus, operation would be impaired by like charging (i.e., both positive or both negative) of the different electrodes 52 and 54 to different magnitudes. Similarly, the polarization states and the field polarity can be reversed by connecting uninsulated electrode grid 54 to a negative charge and connecting insulated electrode grid 52 to a positive charge. In this latter case, corona precharging grid 50 must be changed to a positive charging element, in order to preserve the integrity of the 'special relationship.' This change is required because positive charges are required to neutralize net negative charges that tend to migrate and become trapped proximal to (the now positively charged) insulated electrode grid 23.

Laboratory test data confirms that applied fields exceeding about seven kV/inch accelerate the demise of microbial organisms, however, this effect is not fully understood. It has been heretofore impossible to obtain fields of this magnitude in prior art filtration devices because of the arcing problem. The microbial-destruction field effect is also not consistently observed in all cases. It is believed that the effect can be enhanced by utilizing a field of alternating frequency, and selectively varying the frequency to optimize the effect upon specific microorganisms.

Figure 5:
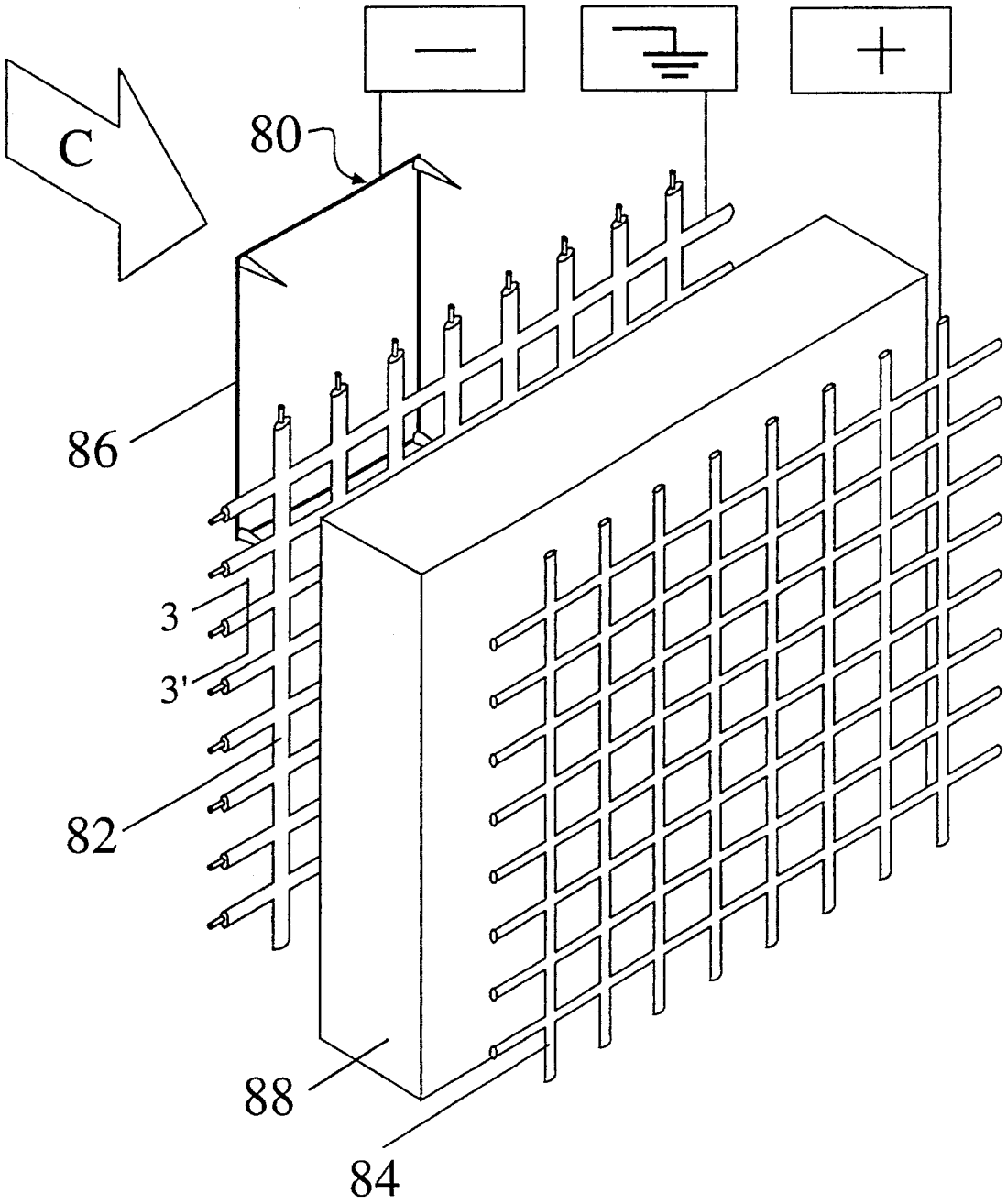
FIG. 5 depicts a top left side elevational perspective view of a third embodiment according to the present invention.

FIG. 5 depicts filtration system 80, which is a less efficient embodiment than the embodiments of FIGS. 1, 2, and 3. Most naturally occurring dust particles are positively charged dust particles that have an affinity for the grounded insulated first electrode 82, which provides a negative field dipole due to the fact that uninsulated electrode 84 has a positive charge. The corona precharger 86 is negatively charged. The fibrous filter 88 collects particles that miss the grounded first electrode 82. Due to the prevalence of naturally charged dust particles and the negatively charged dust particles that derive from corona precharger 86, grounded first 82 and the filter surfaces proximal to grounded first electrode 82 tend to become prematurely clogged with trapped particles. The configuration of system 90 is sometimes preferred for various reasons including the desirability of washing, collecting, and analyzing dust samples from grounded first electrode 82.

Figure 6:
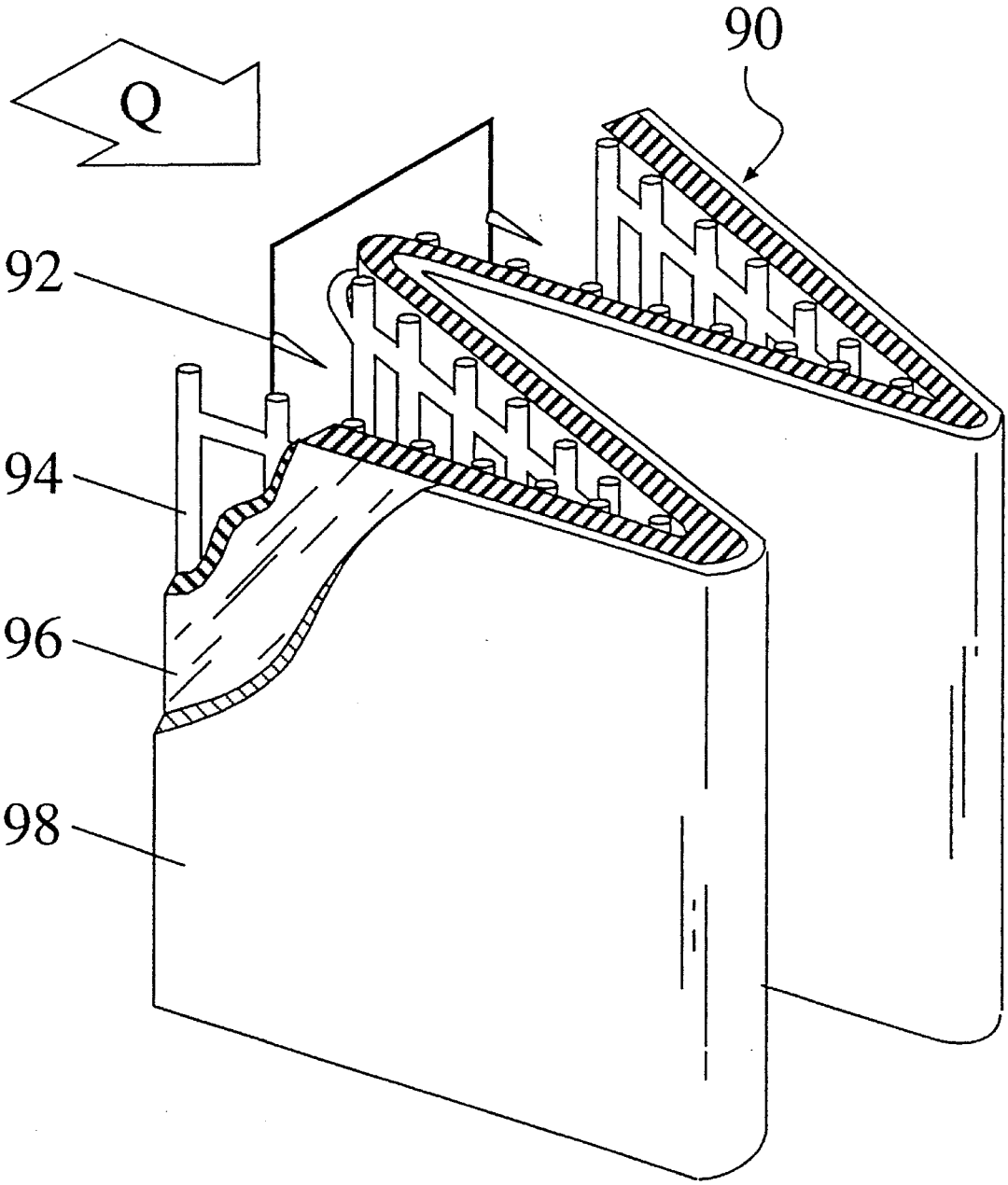
FIG. 6 depicts a top left side elevational perspective view of a pleated filter including an added activated carbon fibrous layer.

FIG. 6 depicts an airflow Q passing through a pleated filter assembly 90 of the type depicted in FIG. 1. Pleated filter assembly 90 is preceded by a corona precharger 92, which is analogous to precharging grid 32 of FIG. 1. A first insulated electrode 94 (compare to insulated electrode grid 34 of FIG. 1) has the same charge as the corona precharger 92. A fibrous filter medium 96 (see fibrous filter element 36 of FIG. 1) is polarized by an uninsulated activated carbon electrode 98 (see carbon electrode 42 of FIG. 1) having an opposite charge to that of first insulated electrode 94 or a ground connection and the first electrode.

The W-shaped construction of pleated filter assembly 90 provides an increased filtration surface area because the air flow Q passes through filter 96 in a perpendicular orientation with respect to the filter surfaces along the W-shaped wall. Thus, the velocity of air through filter assembly 90 is reduced as a function of the increased filtration surface area. Filtration efficiency is correspondingly enhanced because filters remove a greater percentage of particulates under reduced velocity of flow conditions.

Figure 7:
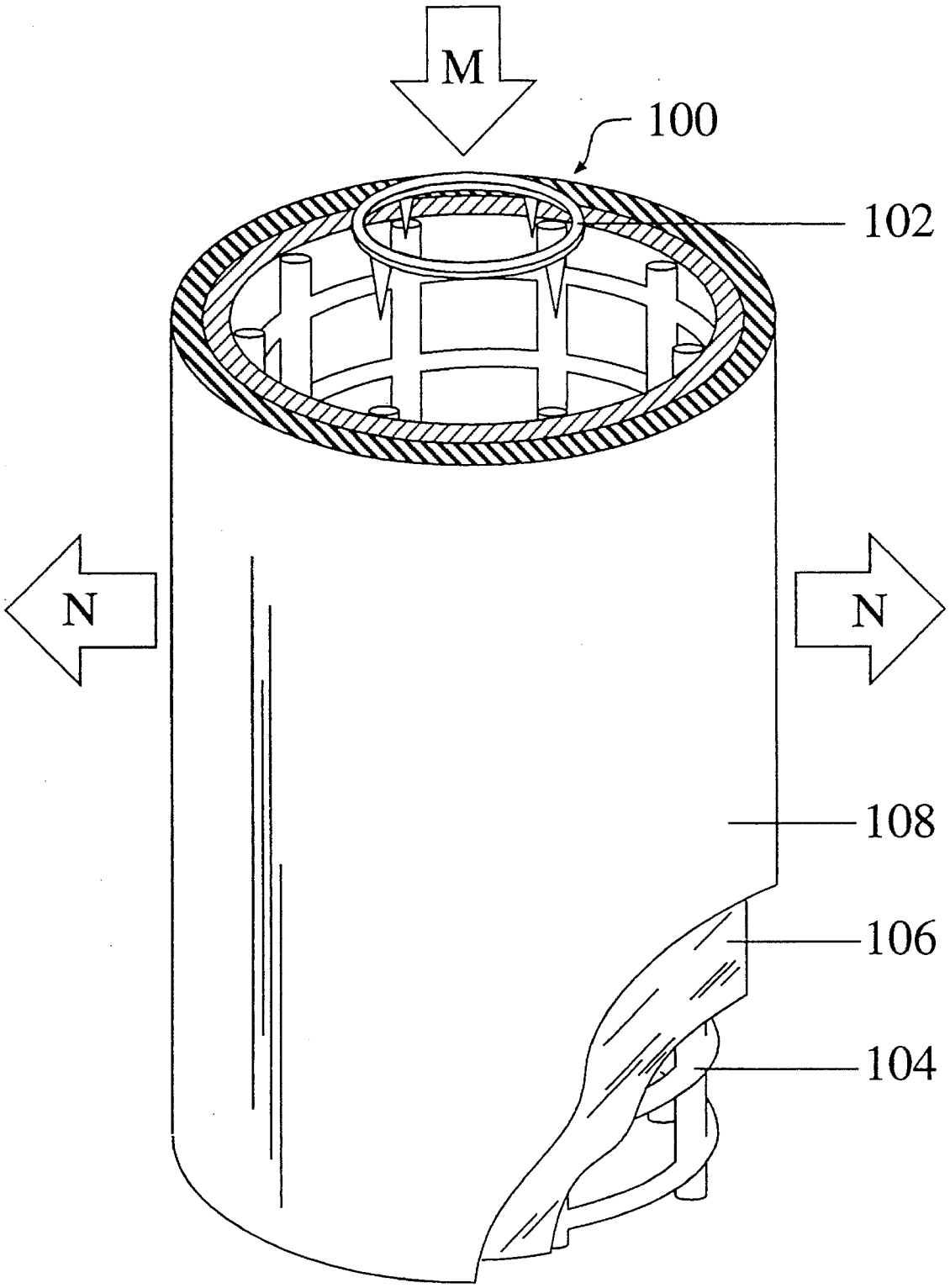
FIG. 7 depicts a top left side elevational perspective view of a cylindrical fourth embodiment according to the present invention.

FIG. 7 depicts a cylindrical filter 100 having incoming air M. Air M sequentially passes through precharger 102, insulated first electrode, fibrous filter 106, and a second electrode 108 made of activated carbon. Precharger 102 and first insulated electrode 104 preferably have the same (positive or negative) charge. Second electrode 108 is uninsulated, and grounded or of opposite polarity with respect to first electrode 104. Output air is indicated by N.

The following nonlimiting examples set forth preferred materials and methods for use in practicing the present invention.

EXAMPLE 1

Electronically Enhanced Filtration Efficiency Test

A filtration efficiency test was conducted to determine the filtration efficiency of a conventional fiberglass medium. The test was conducted in a test chamber that was constructed according to ASHRAE standards for the testing of High Efficiency Particle Arrestor ("HEPA") grade filters utilizing D.O.P. particles at an airflow rate of 100 cubic feet per minute (cfm). An electronically enhanced filtration apparatus was assembled as depicted in FIG. 2. The applied field between the electrode grids 52 and 54 was 14 kV.

The object of the testing was to determine if a low-cost, low-resistance, open type filter media (which typically also has a low particle removal efficiency) could be turned into a high efficiency filter by pre-ionizing particles before they entered the filter and by establishing an electrostatic field across the filter media to charge and polarize the fibers.

Test Apparatus

The test apparatus utilized a 24 inch by 24 inch insulated electrode grid positioned across an air duct. The grid was constructed on a 24 inch by 24 inch frame made of aluminum angle. A continuous wire was strung through this frame at one inch intervals to form a grid configuration. The wire was coated with a 3.04 mm thick coating of polyethylene at its outer diameter. The grid was connected to a high voltage DC power supply. The power supply was configured to place a negative 14 kV potential on the insulated grid.

A ground electrode utilized a similar 24 inch by 24 inch aluminum frame, but the ground electrode itself was made of wire cloth having ¼ inch by ¼" spacings. The wire cloth was connected by a wire to an electrical ground. The two electrodes were separated by a 24 inch by 24 inch section of fibrous filtration medium. The medium was a fiberglass medium made by Johns Manville Company of Denver, Colo. The filter was ¾" thick, and was designated as General Purpose by the manufacturer.

A corona precharger was positioned upstream of the electrodes. Six ionizers having respective lengths of four inches were positioned a distance of four inches in front of the insulated electrode pointing towards the insulated electrode. The ionizers were made of elongated four inch long hollow acrylic tubes having an outer diameter of ¼ inch. A stainless steel needle was placed on one end of the tube. In each case, a high voltage wire was placed through the tube to make an electrical contact with the needle. The wires were connected to the power source to impose a 14 kV potential on the needles.

Test Operation

Air within the system was first filtered through HEPA filters and then D.O.P. particles were generated into the controlled air flow. The particle concentration and sizes were measured by a Climet CL-6300 Laser particle Counter prior to the air entering the test filter and after leaving the test filter. The particle count data was used to determine the overall filtration efficiency of the HEPA medium. The particle counter provided measurements in the size ranges of 0.19 micron to 0.3 micron, 0.3 to 0.5 micron, 0.5 to 1 micron, 1 to 3 microns, 3 to 5 microns, and particles greater than 5 microns. The particle counter also provided a totalized count of all particles together.

Each test consisted of four separate sets of particle counts before and after filtration. The data was provided as "Particle Size", "Particle count upstream" (before the filter), "Particle count downstream" (after the filter), and "Efficiency" (in percentage of particles removed). Also provided, were the total number of particles "Upstream" and "Downstream," and overall particle removal efficiency. Table 1 provides the test results.

TABLE 1

Manville Technical Center — Reinforcements & Filtration
Filter Efficiency Tests
Using Climet CL-6300 Laser Particle Counter

7/23/91 — 15:18

TEST PARAMETERS

| | | | |
|---|---|---|---|
| Test Number | 2957 | Filter Media | COP-GP-3/4 |
| Particles | | Filter Backing | |
| Filter Air Flow | 100 cfm | Machine | |
| Pressure Drop | .090 in Wg | Job Number | |
| Temperature | 83.6 F | Roll | |
| Rel Humidity | 45.2% | Lane | |
| Counter Air Flow | .099 cfm | Year Manuf | 91 |
| Sample Time | 00:30 min:sec | Day Manuf | |
| Delay Time | 10 sec | Shift Manuf | |
| Misc Info | CHARGE + IONIZATION | | |
| Counting Mode | Differential | Cycles | 4 |

TEST RESULTS

| Particle Size µm | Particle Count upstream | (sum of cycles) downstream | Efficiency % |
|---|---|---|---|
| .19 to .3 | 26118 | 160 | 99 |
| .3 to .5 µ | 27519 | 64 | 99 |
| .5 to 1 µ | 33369 | 88 | 99 |
| 1 to 3 µ | 5145 | 9 | 99 |
| 3 to 5 µ | 94 | 0 | 100 |
| >5.00 µ | 10 | 0 | 100 |
| total | 92255 | 32105 | 99.65 |

Figure 8:
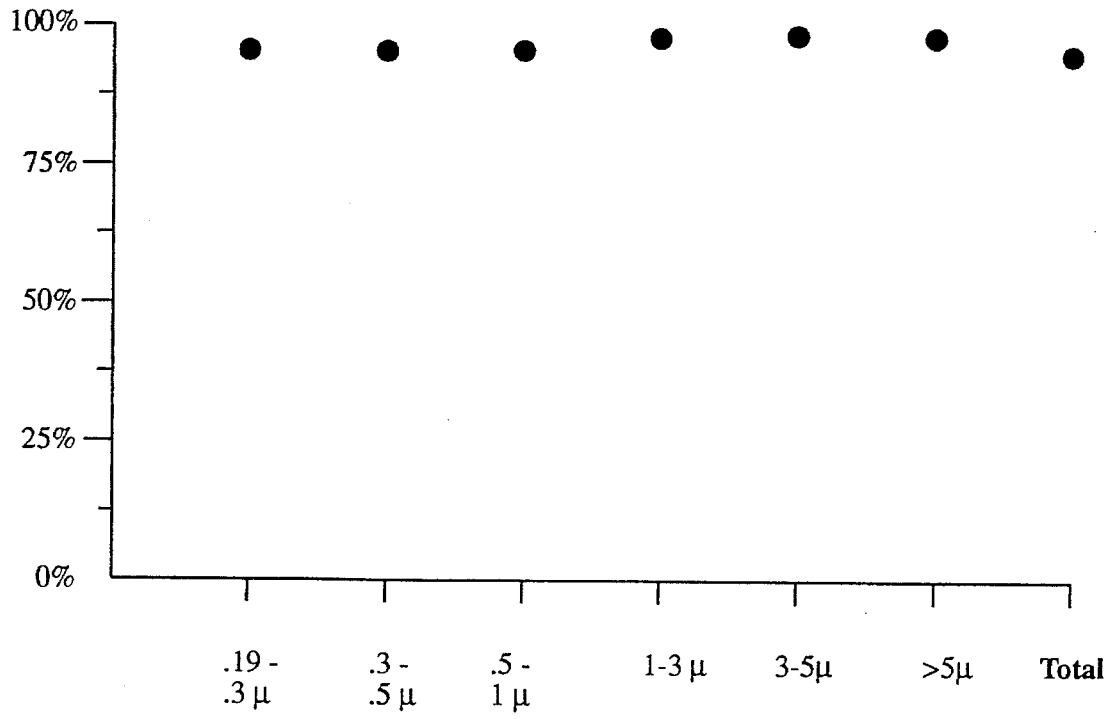
FIG. 8 depicts a plot of filtration efficiency for various particles size ranges including test data that was obtained from the use of an electronically enhanced fibrous filter according to the embodiment of FIG. 2.

FIG. 8 depicts these results as a plot of particle removal efficiency for the various size ranges. With ionization and an electrostatic field, the overall efficiency of the filter media was 99.65% or more. Furthermore, there was only a percentage point difference between the removal efficiency for larger particles and that for the sub-micron sized particles. The laser particle counter was unable to measure particles smaller than 0.19 micron in size, but it is expected that the removal efficiency would remain as high for particles down to 0.01 micron in size.

This test demonstrated that a low-cost filter medium, which has low resistance to airflow (due to its open structure and low fiber content), can be operated into a high efficiency filter by the incorporation of particle ionization and electrostatic fields established across the medium.

COMPARATIVE EXAMPLE 2

Filtration Efficiency with no Electrical Enhancement

Test were conducted on the filtration apparatus of Example 1 in an identical manner to that described in Example 1, except the power supply was turned off. Thus, the apparatus provided no electronic enhancement to the General Purpose filter.

Several tests on the filter medium (without any ionization, or electric field) demonstrated that the filter medium had an overall efficiency ranging from 12% and 23% on average across the particle size ranges tested. The "uncharged" filter media' worked best on particles larger than 1 micron in size, and became substantially worse on sub-micron size particles. Table 2 provides exemplary test results.

TABLE 2

Manville Technical Center Reinforcements & Filtration
Filter Efficiency Tests
Using Climet CL-6300 Laser Particle Counter

7/23/91 14:43

TEST PARAMETERS

| | | | |
|---|---|---|---|
| Test Number | 2953 | Filter Media | COP-GP-3/4 |
| Particles | | Filter Backing | |
| Filter Air Flow | 100 cfm | Machine | |
| Pressure Drop | .095 in Wg | Job Number | |
| Temperature | 83.6 F | Roll | |
| Rel Humidity | 45.6% | Lane | |
| Counter Air Flow | .099 cfm | Year Manuf | 91 |
| Sample Time | 00:30 min:sec | Day Manuf | |
| Delay Time | 10 sec | Shift Manuf | |
| Misc Info | NO CHARGE | | |
| Counting Mode | Differential | Cycles | 4 |

TEST RESULTS

| Particle Size µm | Particle Count upstream | (sum of cycles) downstream | Efficiency % |
|---|---|---|---|
| .19 to .3 | 26972 | 23050 | 14 |
| .3 to .5 µ | 27452 | 23130 | 15 |
| .5 to 1 µ | 32225 | 26048 | 19 |
| 1 to 3 µ | 4490 | 3513 | 21 |
| 3 to 5 µ | 94 | 50 | 46 |
| >5.00 µ | 10 | 14 | −39 |
| total | 91243 | 75805 | 16 |

Figure 9:
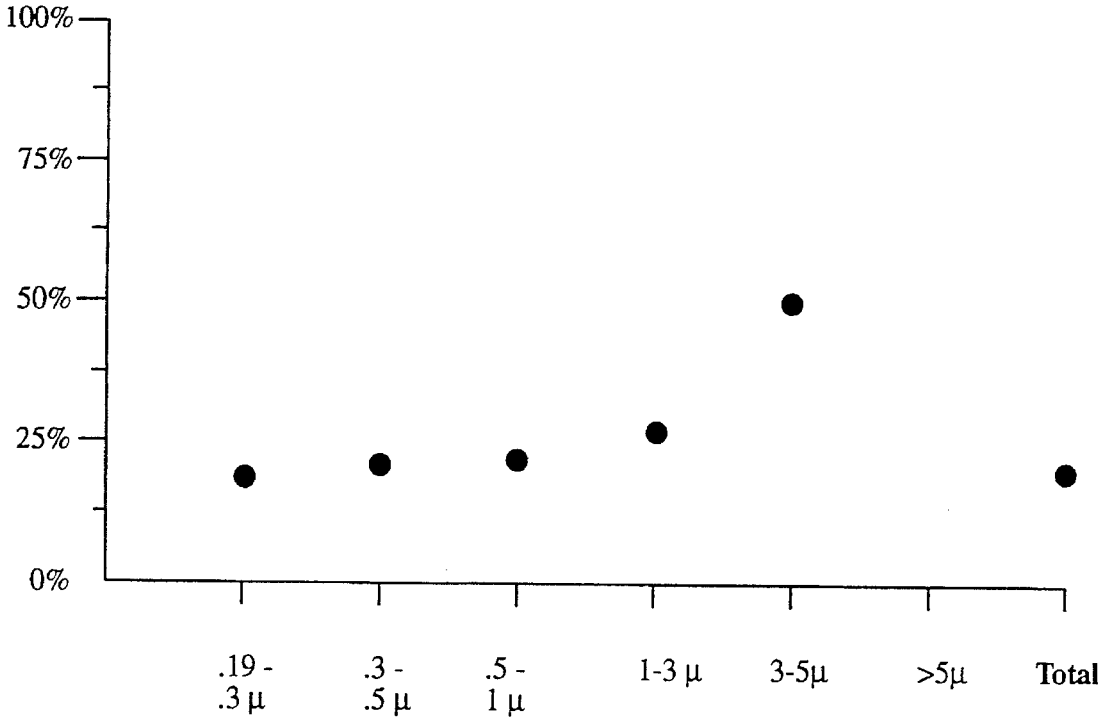
FIG. 9 depicts a plot of filtration efficiency for various particles size ranges including test data that was obtained from the use of an uncharged fibrous filter.

FIG. 9 depicts these results. The conventional fibrous filter was used with no electrostatic field, and had an overall particle removal efficiency of about 16%. It is noted that the particle size range >5.00 µ increased due to particle agglomeration and throughput. Thus, some of the particles that were indicted to be removed from other ranges were released as agglomerates.

Examination of the test filter medium revealed that the particle buildup on, and within, the filter media occurred in very different ways, respectively, for the charged and uncharged media. The pattern of particle buildup on the charged media increases its useful life (the time until the dirt buildup causes too much resistance to airflow) to a value approximately three times that of the uncharged media. This longevity occurred even though the charged medium collected many times more particulate pollutants than the uncharged medium.

EXAMPLE 3

Filtration with no Precharging

The test of Example 1 was repeated, except the precharger (including the needles mounted on acrylic tubes) was disconnected. Table 3 provides the test results.

TABLE 3

Manville Technical Center Reinforcements & Filtration
Filter Efficiency Tests
Using Climet CL-6300 Laser Particle Counter

7/23/91 14:43

TEST PARAMETERS

| | | | |
|---|---|---|---|
| Test Number | 2955 | Filter Media | COP-GP-3/4 |
| Particles | | Filter Backing | |
| Filter Air Flow | 100 cfm | Machine | |
| Pressure Drop | .095 in Wg | Job Number | |
| Temperature | 84.4° F. | Roll | |
| Rel Humidity | 45.2% | Lane | |
| Counter Air Flow | .097 cfm | Year Manuf | 91 |
| Sample Time | 00:30 min:sec | Day Manuf | |
| Delay Time | 10 sec | Shift Manuf | |
| Misc Info | 14 kV CHARGE | | |
| Counting Mode | Differential | Cycles | 4 |

TEST RESULTS

| Particle Size µm | Particle Count upstream | (sum of cycles) downstream | Efficiency % |
|---|---|---|---|
| .19 to .3 | 23934 | 7033 | 70 |
| .3 to .5 µ | 24965 | 5365 | 78 |
| .5 to 1 µ | 31558 | 3046 | 90 |
| 1 to 3 µ | 5551 | 88 | 98 |
| 3 to 5 µ | 124 | 0 | 100 |
| >5.00 µ | 14 | 0 | 100 |
| total | 86150 | 75805 | 81 |

Figure 10:
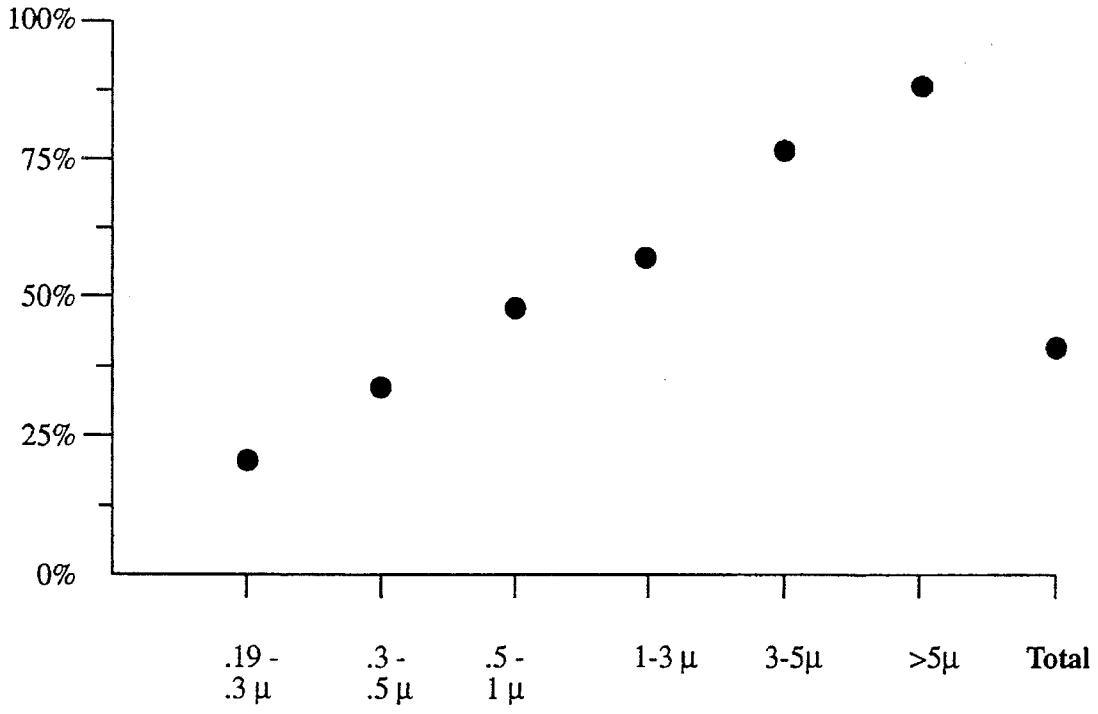
FIG. 10 depicts a plot of filtration efficiency for various particles size ranges including test data that was obtained from the use of a fibrous filter with only partial electronic enhancement.

FIG. 10 depicts the results of Table 3. Polarizing the filter, alone and without corona precharging, provided acceptable results for particles exceeding one µm, however, efficiency was greatly reduced on particles below one µm in diameter, as compared to the results of Example 1.

Those skilled in the art will understand that the preferred embodiments that are described hereinabove can be subjected to apparent modifications without departing from the true scope and spirit of the invention. The inventor, accordingly, hereby states his intention to rely upon the Doctrine of Equivalents, in order to protect his full rights in the invention.

I claim:

1. A method for electronically enhancing the ability of a filter to remove airborne particulate, said method comprising the steps of:

charging airborne particles to provide charged particles;

creating a potential difference between an electrode pair that includes an insulated electrode and an uninsulated electrode separated by a filter;

inducing a polarization state in said filter, in response to said creating step, wherein surfaces of said filter proximal to said insulated electrode have a dipole oppositely charged with respect to the charge of said charged particles, and wherein surfaces of said filter remote from said insulated electrode have a dipole of the same charge with respect to the charge of said charged particles;

contacting said filter in said polarization state with an air flow that includes naturally charged particles to impart net charges provided by said naturally charged particles to said filter medium; and removing a portion of said net charges from said filter through contact between said filter and said charged particles.

2. The method as set forth in claim 1 wherein said naturally charged particles include positively charged particles and negatively charged particles, and said contacting step includes a step of separating a negative charge and a positive charge imparted to said filter by said naturally charged particles.

3. The method as set forth in claim 2 including a step of draining one of said positive charge and said negative charge from said filter to said uninsulated electrode subsequent to said separating step.

4. The method as set forth in claim 2 wherein said removing step serves to remove a trapped charge from filter surfaces proximal to said insulated electrode.

5. The method as set forth in claim 1 wherein said creating step includes said potential difference having a ratio greater than about 30:1 determined as potential difference in kilovolts to filter thickness in inches.

6. The method as set forth in claim 1, wherein said filter is a fibrous filter.

7. The method as set forth in claim 1 including a step of retaining on said filter at least about 99% of all airborne particles having effective particle diameters ranging from about 0.2 μm to about 5 μm.

8. The method as set forth in claim 7 wherein said filter in an uncharged state has a particle removal efficiency of less than about 20% across said particle diameter range.

9. The method as set forth in claim 1 wherein said charging step is conducted at a voltage of at least about 20 kV.

10. An electronically enhanced air filtration apparatus for use in filtering air, comprising:

means for charging airborne particles to provide charged particles;

an electrode pair assembly including an insulated electrode and an uninsulated electrode separated by a filter means for creating a potential difference between said insulated electrode and said uninsulated electrode across said filter to induce a polarization state in said filter, said filter in said polarization state including filter surfaces proximal to said insulated electrode having a dipole oppositely charged with respect to the charge of said charged particles provided by said charging means, and filter surfaces remote from said insulated electrode have a dipole of the same charge with respect to the charge of said charged particles;

means for contacting said filter in said polarization state with an air flow including naturally charged particles to impart net charges provided by said naturally charged particles to said filter medium; and removing a portion of said net charges from said filter through contact between said filter and said charged particles.

11. The apparatus as set forth in claim 10 wherein said contacting means includes means for separating a negative charge and a positive charge imparted to said filter by said naturally charged particles.

12. The apparatus as set forth in claim 10 wherein said separating means includes means for draining one of said positive charge and said negative charge from said filter to said uninsulated electrode.

13. The apparatus as set forth in claim 10 wherein said removing means includes means for removing a trapped charge from filter surfaces proximal to said insulated electrode.

14. The apparatus as set forth in claim 10 wherein said creating means includes means for providing said potential differences having a ratio greater than 30:1 determined as potential difference in kilovolts to filter thickness in inches.

15. The apparatus as set forth in claim 10 wherein said filter is a fibrous filter.

16. The apparatus as set forth in claim 15 including means for operating said apparatus to retaining on said fibrous filter at least about 99% of all airborne particles having effective particle diameters ranging from about 0.2 μm to about 5 μm.

17. The apparatus as set forth in claim 16 wherein said filter in an unpolarized state has a particle removal efficiency rating of less than about 20% over said range of particle diameters.

18. The apparatus as set forth in claim 10 wherein said potential difference creating means is conducted at a voltage of at least about 20 kV.

* * * * *